United States Patent [19]

Lonardi et al.

[11] Patent Number: 4,844,292

[45] Date of Patent: Jul. 4, 1989

[54] MECHANISM FOR ACTUATING AN OPENING AND SHUT-OFF VALVE

[75] Inventors: Emile Lonardi, L-Bascharage; Pierre Mailliet, L-Howard, both of Luxembourg

[73] Assignee: Paul Wurth S.A., Luxembourg

[21] Appl. No.: 168,973

[22] Filed: Mar. 16, 1988

[30] Foreign Application Priority Data

Mar. 24, 1987 [LU] Luxembourg ..... 86821

[51] Int. Cl.[4] ..... B65D 47/00

[52] U.S. Cl. ..... 222/503; 74/471 R; 105/247; 222/506; 222/545; 251/212; 294/68.24; 298/35 M

[58] Field of Search ..... 222/334, 502–506, 222/545, 556, 558, 559, 560; 414/328, 329, 414; 298/35 R, 35 M, 37; 105/240, 247, 248, 250, 253, 280, 284, 286, 299, 306; 294/68.24; 74/471 R, 519; 251/58, 212, 228, 229, 232, 279, 301

[56] References Cited

U.S. PATENT DOCUMENTS

| | | | |
|---|---|---|---|
| 2,069,739 | 2/1937 | Fildes et al. | 222/503 |
| 2,284,781 | 6/1942 | Ward | 222/503 |
| 2,375,371 | 5/1945 | Kuehlthau | 294/68.24 X |
| 2,636,648 | 4/1953 | Richardson | 294/68.24 X |
| 2,721,761 | 10/1955 | Le Tourneau | 222/503 X |
| 2,785,840 | 3/1957 | Nave | 251/212 X |
| 2,812,970 | 11/1957 | Martinson | 222/503 X |
| 2,836,461 | 5/1958 | Shadwick et al. | 298/35 M |
| 2,901,148 | 8/1959 | Cunningham et al. | 294/68.24 X |
| 3,145,057 | 8/1964 | Taggart | 222/503 X |
| 3,998,426 | 12/1976 | Isbester | 251/212 X |

FOREIGN PATENT DOCUMENTS

| | | | |
|---|---|---|---|
| 2081198 | 2/1982 | United Kingdom | 105/247 |

*Primary Examiner*—Kevin P. Shaver

*Attorney, Agent, or Firm*—Fishman, Dionne & Cantor

[57] ABSTRACT

A valve actuating device for a hopper is comprised of two spherical shaped shutters or registers which pivot about common suspension axles. Each of the registers is carried by two pairs of arms located on either side of the bottom of the hopper and is capable of pivoting about two axles mounted respectively on brackets fastened to the bottom on either side of the hopper. The supporting arms of one of the registers are connected respectively to the piston rods of two hydraulic jacks mounted pivotally on the brackets; and the first pair of supporting arms experiencing the action of the hydraulic jacks are connected respectively to the second pair of supporting arms by use of a linkage articulated on the bracket.

9 Claims, 3 Drawing Sheets

MECHANISM FOR ACTUATING AN OPENING AND SHUT-OFF VALVE

BACKGROUND OF THE INVENTION

This invention relates to a mechanism for actuating an opening and shut off valve for the outflow orifice in the bottom of a stand-by hopper of a loading installation for a shaft furnace. More particularly, this invention relates to a new and improved valve actuating mechanism comprised of two registers, each in the form of a cylindrical or spherical cap and pivoting in opposite directions about their common suspension axles so as to define a central outflow orifice symmetrically variable about the central outflow axis of the hopper; and which has drive means acting on at least one of the shutters.

The present invention is particularly well suited for use with a valve for a stand-by hopper for an installation of the central loading type, such as that described in the patent EP-B1-0062770 corresponding to U.S. Pat. No. 4,514,129, assigned to the assignee hereof, all of the contents which are incorporated herein by reference. This stand-by hopper acts to fill (as quickly as possible) a lock chamber which is arranged immediately below the hopper and from which the flow of loading material towards the means of a distribution in the furnace (which is usually a rotary or oscillating chute), is adjusted. The lock chamber possesses a cylindrical outflow pipe, the orifice of which is equipped with a proportioning valve of the type described above. A mechanism of the above-described type for actuating such a proportioning valve is disclosed in the document EP-B1-134,918 corresponding to U.S. Pat. No. 4,570,900, which is assigned to the assignee hereof, all of the contents of which are incorporated herein by reference.

Unfortunately, this known valve actuating mechanism cannot be used for the valves covered by the present invention. One of the reasons for this is that the stand-by hopper has to be emptied as quickly as possible in order to curtail any idle time during loading. For this reason, its outflow orifice must be as large as possible; and the valve associated with its outflow orifice must similarly be designed to allow for this large size. However, the proportioning valve described in U.S. Pat. Nos. 4,514,129 and 4,570,900 which is associated with the outflow pipe of the lock chamber is of much smaller size. In particular, these known valves consist of two registers or shutters in the form of spherical caps which are supported directly by their pivot axles. It is these pivot axles which are actuated by the drive means.

In contrast, the valves for which the present invention is intended must have a larger radius of curvature. This is because they are not associated with a cylindrical outflow pipe (as in the prior art), but are instead associated with the bottom of a funnel shaped hopper. Because of the funnel shaped hopper, the two registers cannot each pivot 90°. Consequently, the two shutters must be mounted on supporting arms pivoting about the axis of rotation of the registers; and because of the size of the registers and that of the outflow orifice, these supporting arms have to be relatively long. As a result, if the drive means were to act on the rotary axle of the supporting arms in order to actuate the registers, there would be a loss of force due to the negative lever effect caused by the relatively long supporting arms. In view of this loss and because of the size of the registers, the drive means would have to be very powerful and their suspension would have to be constructed accordingly.

Moreover, it will be appreciated that, in recent installations, the stand-by hopper together with its shut off valve are designed to be rotatable about its vertical axis in order to prevent the effect of segregation of the particles during filling. Consequently, the mechanism for actuating the known valves associated with the outflow pipe of the lock chamber is not suitable for a rotating hopper because of the lateral bulk of the control mechanism.

SUMMARY OF THE INVENTION

The above discussed and other drawbacks and deficiencies of the prior art are overcome or alleviated by the novel mechanism of the present invention for actuating a shut-off and non-return valve for the outflow orifice of a stand-by hopper. In accordance with the present invention, this new and improved actuating mechanism has a simple and effective construction which permits it to be easily removable from the bottom of the stand-by hopper; and also permits the use thereof with a rotary stand-by hopper.

The present invention comprises a pair of shutters or registers, each in the form of a cylindrical or spherical cap; and each being pivotable in opposite directions about their common suspension axles so as to define a central outflow orifice symmetrically variable about the central axis of the hopper. Drive means are provided which act on at least one of the registers.

In a preferred embodiment of the present invention, each of the registers is carried by a pair of supporting arms located on either side of the bottom of the hopper. The arms are capable of pivoting about two axles mounted respectively on brackets fastened to the bottom of the hopper on either side thereof. This is accomplished by connecting the supporting arms of one of the registers respectively to the piston rods of two hydraulic jack mounted pivotably on the brackets. The two supporting arms experiencing the action of the jacks are connected respectively to the other two supporting arms by means of a linkage articulated on the bracket.

Each of the linkages preferably comprises a pair of parallel arms, the first pair of parallel arms being fixed to the supporting arm experiencing the action of the hydraulic jack and the second pair of parallel arms being mounted on a pivot axle parallel to the suspension and pivot axle of the supporting arms. A rod connects the ends of the two arms to form a structure in the form of a deformable parallelogram. A lever connects the end of the second arm to that supporting arm which is not directly experiencing the action of the hydraulic jack.

The second supporting arm preferably comprises two parallel branches fixed to one another, one of these branches being connected to the first arm by means of the rod and the other branch being connected by means of the lever to the supporting arm not directly experiencing the action of the hydraulic jack.

In accordance with another feature of the present invention, each of the shutters is removable from its supporting arm.

The above discussed and other features and advantages of the present invention will be appreciated and understood by those of ordinary skill in the art from the following detailed description and drawings.

BRIEF DESCRIPTION OF THE DRAWINGS

Referring now to the drawings wherein like elements are numbered alike in the several figures.

DESCRIPTION OF PREFERRED EMBODIMENTS

Figure 1:
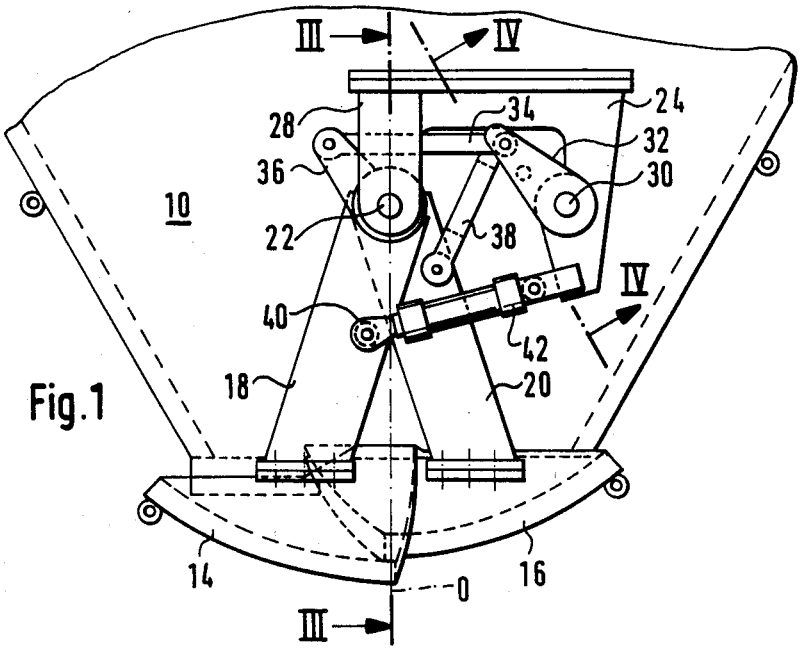
FIG. 1 is a side elevation view of the valve with its control mechanism in the closed position.
Figure 2:
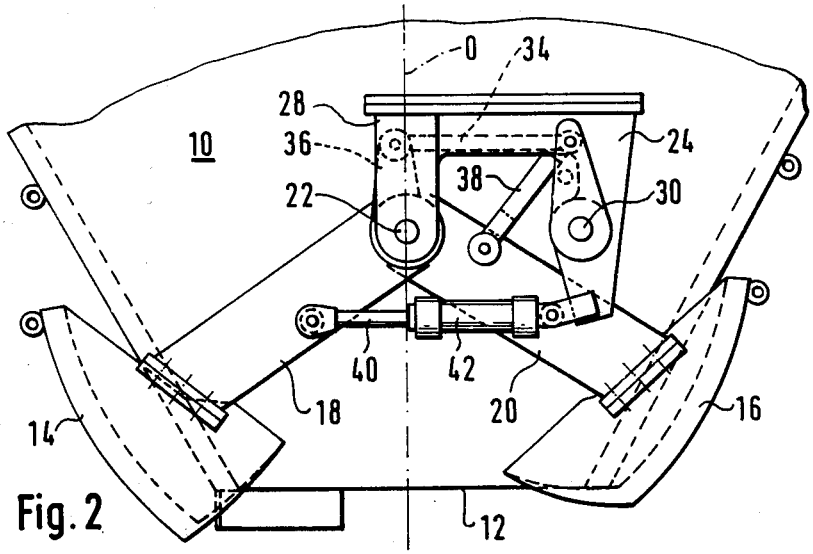
FIG. 2 is a side elevation view of the valve of FIG. 1. with the valve in the open position.

Referring first to FIGS. 1 and 2, a funnel shaped bottom 10 of a stand-by hopper is shown having a circular outflow orifice 12 about the central axis 0. Associated with this orifice 12 is a shut off and non-return valve consisting of two shutters or registers 14 and 16 in the form of cylindrical or spherical caps shiftable relative to one another in opposite directions in order to define a variable outflow orifice symmetrically positioned about the central axis 0. For this purpose, the two shutters 14 and 16 are provided with orifices symmetrical and opposite in relation to one another, described in the above mentioned U.S. Pat. Nos. 4,514,129 and 4,570,900, with the exception that the two shutters have a much greater radius of curvature and a much larger size.

The two shutters 14 and 16 are carried respectively by a pair of supporting arms 18 and 20 on the two opposite side of bottom 10. It will be appreciated that the supporting arms on the hidden side of FIGS. 1 and 2 are not seen in these FIGURES.

The suspension apparatus and the mechanism for synchronously actuating the two shutters 14 and 16 is described with simultaneous reference to FIGS. 1–4.

Figure 3:
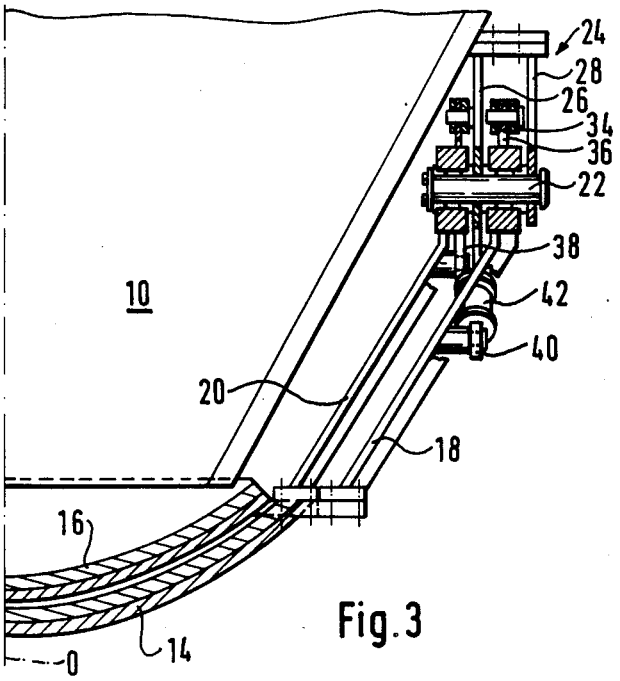
FIG. 3 is a cross sectional elevation view along the line III—III of FIG. 1.
Figure 4:
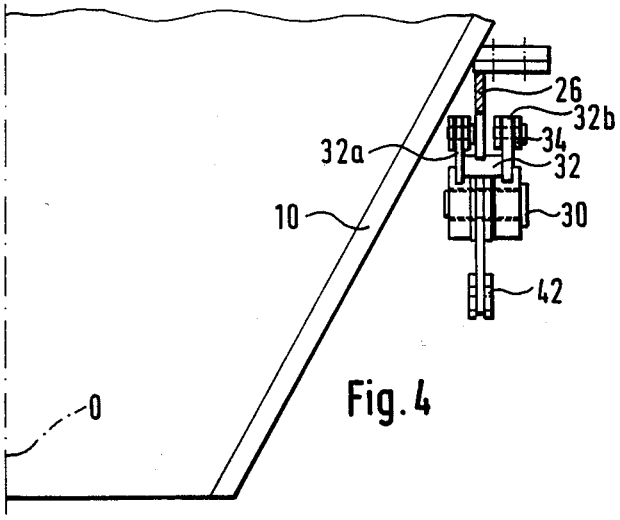
FIG. 4 is a cross sectional elevation view along the line IV—IV of FIG. 1.

As shown in more detail in FIG. 3, the two arms 18 and 20 can pivot about a common suspension axle 22 carried between two plates 26, 28 of a bracket 24 which is welded to the outer wall of the bottom 10 of the stand-by hopper. A suspension, similar to a that of FIG. 3, for the hidden arms is located on the opposite side in relation to the axis 0, but has not been shown because the description of that which can be seen in FIG. 3 applies equally to the other.

Plate 26 of bracket 24 is in the form of an upturned "U" (see FIGS. 1 and 2), of which one of the legs supports the suspension axle 22, while the other leg carries an axle 30, on which a double arm 32 with two parallel branches 32*a*, 32*b* (see FIG. 4) is pivotably mounted. Branch 32*b* is connected by means of a rod 34 to an arm 36 which is fixed to supporting arm 18. Branch 32*b* is parallel to arm 32 in such a way that rod 34 forms, together with parallel arms 32 and 36, a structure in the form of a deformable parallelogram about axles 22 and 30. The end of the second branch 32*a* of the double arm 32 is connected by means of a lever 38 to supporting arm 20 of shutter 16. As shown in FIGS. 1 and 2, the other supporting arm 18 is connected to the end of the piston rod 40 of a hydraulic jack 42 pivotably mounted on bracket 24 and, more specifically, on the plate 26 below axle 30 supporting double arm 32.

The mode of operation of the mechanism for actuating the two shutters 14 and 16 emerges from FIGS. 1 and 2. In the closed position of shutters 14 and 16 (see FIG. 1), rod 40 of jack 42 is retracted. When jack 42 is actuated, it acts on supporting arm 18 in the opening direction. The pivoting of supporting arm 18 results, via arm 36 and rod 34, in a corresponding pivoting of double arm 32; that is, there will be an opening or raising of the parallelogram structure previously inclined in FIG. 1. By means of lever 38, the pivoting of arm 32 drives supporting arm 20 as a result of a pull exerted thereon. As a result, supporting arm 20 finally pivots in opposed synchronism with supporting arm 18 until shutters 14 and 16 have completely opened to the position shown in FIG. 2.

Figure 5:
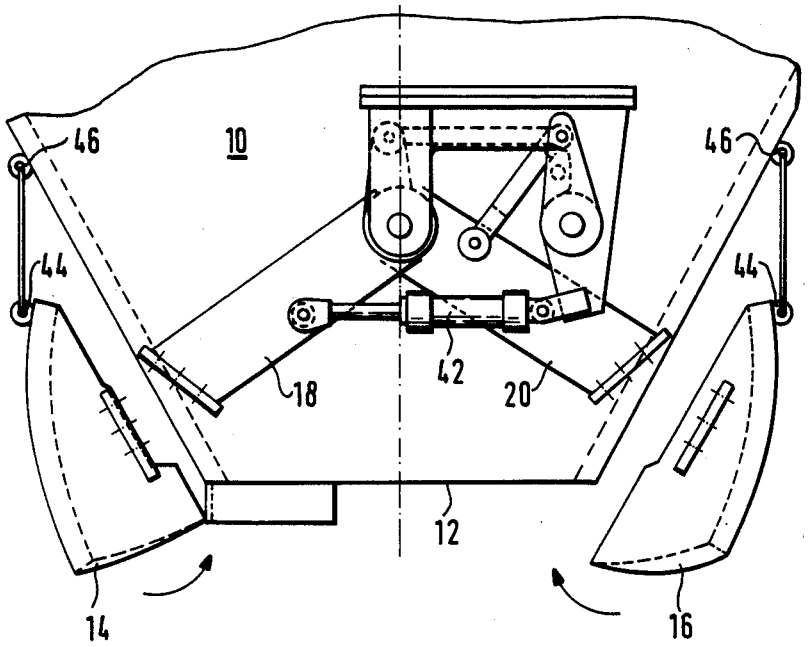
FIG. 5 is a side elevation view, similar to FIG. 2, showing the removal of the shutters.

The two registers 14 and 16 are bolted to their respective supporting arms 18 and 20, and as shown in FIG. 5 they can be easily removed when the valve is in the open position. To make removal easier, each of the shutters 14 and 16 is preferably equipped with a lug 44 so that it can be attached, by means of a cable, to a lug 46 provided on the outer wall of the bottom 10 of the stand-by hopper.

The suspension and drive mechanism on the side of the hopper which cannot be seen in the FIGURES is identical to that described above. However, instead of causing the hydraulic jack not visible in the FIGURES to act on the supporting arm of shutter 14, for reasons of symmetry in terms of force and weight, it is possible to cause it to act on the supporting arm of shutter 16. Thus, each of shutters 14 and 16 experiences the direct action of a hydraulic jack on one side, while on the other side, it tranmits the movement of the other shutter.

The ratio of levers 38, 34 and the connecting point between lever 38 and arm 20 must be calculated to obtain an orifice which is symmetrical and equal in relation to axis 0. This is important because the radii of curvature of the two shutters are different.

It will be appreciated that these parameters may be changed if an assymetric orifice is to be obtained.

It will also be appreciated that the entire actuating mechanism of the present invention is contained in the wasted space around the conical bottom; and that this actuating mechanism does not impede the rotation of the hopper.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for actuating a valve for the outflow orifice of a hopper, the hopper having a central longitudinal axis and including a bottom portion, comprising:

first and second registers having symmetrical cut out portions and pivoting in opposite directions about common suspension axles to define a central outflow orifice variable symmetrically about said central longitudinal axis;

first and second brackets mounted on opposed sides of said bottom portion of the hopper;

first and second pairs of supporting arms located on opposed sides of said bottom portion of the hopper and capable of pivoting about said common suspension axles, said first and second pairs of supporting arms being mounted respectively on said first and second brackets, each of said first and second registers being respectively supported by said pairs of supporting arms;

a first jack having a first piston rod and a second jack having a second piston rod, said first jack and said second jack being respectively pivotably mounted on said first and second brackets;

said first pair of supporting arms being connected respectively to said first and second piston rods of said first and second jacks; and a linkage articulated on said first and second brackets, said first pair of supporting arms being connected respectively to said second pair of supporting arms by said linkage.

2. Apparatus according to claim 1 wherein each of said linkage means comprises:

first and second parallel arms terminating at ends, said first parallel arm being fixed to said first pair of supporting arms, said, second parallel arm being mounted on a pivot axle parallel to said suspension axles of axis first and second pairs of supporting arms;

a rod connecting said ends of said first and second parallel arms to define a deformable parallelogram; and a lever connecting an end of said second parallel arm to one of said second pair of supporting arms.

3. Apparatus according to claim 2 wherein:

said second parallel arm comprises two parallel branches fixed to each other, one of said two branches being connected to one of said first parallel arms by means of said rod and the other of said two branches being connected by said lever to one of said second pair of supporting arms.

4. Apparatus according to claim 1 wherein:

each of said registers is removable from said first and second pairs of supporting arms.

5. Apparatus according to claim 2 wherein:

each of said registers is removable from said first and second pairs of supporting arms.

6. Apparatus according to claim 3 wherein:

each of said registers is removable from said first and second pairs of supporting arms.

7. Apparatus according to claim 4 wherein each of said registers includes:

first lug means for attachment by attachment means to second lug means provided on an outer wall of said bottom portion of the hopper during removal.

8. Apparatus according to claim 5 wherein each of said registers includes:

first lug means for attachment by attachment means to second lug means provided on an outer wall of said bottom portion of the hopper during removal.

9. Apparatus according to claim 6 wherein each of said registers includes:

first lug means for attachment by attachment means to second lug means provided on an outer wall of said bottom portion of the hopper during removal.

* * * * *